United States Patent [19]

Bell

[11] Patent Number: 4,892,240

[45] Date of Patent: Jan. 9, 1990

[54] EXOSKETETAL CARRIAGE FOR ARTICLES TO BE CARRIED BY A PERSON

[76] Inventor: Michael S. Bell, 354 Daytona, Goleta, Calif. 93117

[21] Appl. No.: 47,807

[22] Filed: May 8, 1987

[51] Int. Cl.[4] ..... A45F 3/04

[52] U.S. Cl. ..... 224/211; 224/186; 224/189; 224/190; 224/153; 224/262; 224/265

[58] Field of Search ..... 224/153, 201, 188, 189, 224/209, 210, 211, 213, 907, 260, 261, 262, 908, 910, 901, 186, 212, , 259, 265, 266

[56] References Cited

U.S. PATENT DOCUMENTS

| | | | |
|---|---|---|---|
| 791,855 | 6/1905 | Alexander | 224/189 |
| 2,060,751 | 11/1936 | Baxter | 224/261 |
| 2,271,136 | 1/1942 | Geiger | 224/215 X |
| 3,322,312 | 5/1967 | Mitchell | 224/211 |
| 3,547,322 | 12/1970 | Dawson et al. | 224/265 X |
| 3,938,718 | 2/1976 | Madison | 224/262 |
| 4,298,149 | 11/1981 | Gottschalk et al. | 224/201 |
| 4,433,802 | 2/1984 | Woolf | 224/153 |
| 4,561,578 | 12/1985 | Bell | 224/262 |

FOREIGN PATENT DOCUMENTS

| | | | |
|---|---|---|---|
| 0273087 | 7/1988 | European Pat. Off. | 224/213 |

*Primary Examiner*—Ernest G. Cusick

*Attorney, Agent, or Firm*—Donald D. Mon

[57] ABSTRACT

An exoskeletal carriage for articles to be carried by a person. It includes a belt for supporting the carriage. A front and rear blade-like columnar member is attached to the belt. The columnar members include a channel shape along at least a part of their vertical dimension to give columnar support with minimal bending. Articles to be carried can be attached to the columnar members.

17 Claims, 3 Drawing Sheets

EXOSKETETAL CARRIAGE FOR ARTICLES TO BE CARRIED BY A PERSON

FIELD OF THE INVENTION

This invention relates to an exoskeletal carriage to be worn by a person for carrying objects attached to it.

BACKGROUND OF THE INVENTION

The carriage of objects by human beings is among the oldest of the arts. Classically the support of the weight being carried has involved the use of the upper torso, and even also the neck and head as a columnar support for the load. Carriage of objects such as baskets balanced on the head is an ancient example. Carriage with a beam or pole balanced on the shoulder is another ancient example.

Such arrangements are for simpler tasks such as the freighting of objects from one place to another, over relatively regular ground, and with no concurrent need for vigorous other activities. They are not suitable, for example, for soldiers or hikers who must change their postures and gait while still carrying their load. For this purpose there have been developed numerous pack systems, principally to be worn on the back, and with few exceptions to be supported principally on the shoulders. Again, the upper torso is utilized as a supporting column, along with the hips and legs, of course.

The human spine is notoriously subject to strain and damage. Excessive loads, especially those exerted in an eccentric manner, can and do damage the spinal discs. Tilting forces can and do cause disabling strain. In every situation, the need to balance or to lean against the load in such a way as to use the upper torso as a column, and especially to exert restoring forces that keep it and its load in a stabilized condition, is very tiring. An exhausted soldier cannot fight as well. An exhausted hiker cannot fully enjoy the scenery or hike as far.

One mitigating technique is to lighten the payload. For this reason, lightweight dehydrated foods have been prepared. Another is to lighten the pack structure itself. These techniques have inherent limitations. For example some missions require the carriage of sufficient supplies for a soldier to remain independent for a substantial period of time, and lightening the load is impossible. In fact, the available load that can be carried is frequently a limitation on a mission. Lightening the structure of presently-known packs is also inherently limited. The structure still must be strong enough to carry the load and withstand random forces without collapse. The use of lightweight materials and of special cross-sections are routinely resorted to. Still it remains an objective to increase the load which can be carried and to decrease the weight of the structure. An even more important, but heretofore unattained objective is markedly to reduce or preferably to eliminate the stressful forces on the wearer which he must resist when his upper torso is used as a column.

One effort to increase the attainable load provides a wearable vest-like garment, over which the load, such as rounds of ammunition, is distributed. This distribution assists in balancing the load, but the load is still carried by the torso, generally being transferred to the shoulders, or perhaps in part to the torso itself by closely fitting the garment to the shoulders and to the torso. While this arrangement is an improvement over an A-frame for some applications, it is far from a general or optimum solution to the problems.

In U.S. Pat. No. 4,561,578 issued Dec. 31, 1985, to the instant applicant, there is disclosed a pack frame which is supportable at least in part at the waist by an encircling belt. The pack includes a frame mounted to the belt, some over-the-shoulder stabilizing (and usually some load-supporting) straps, and counterweight means to assist in balancing the load. Containers for articles are attached to the frame. Thus, although much or even most of the load is supported at the waist, the upper torso is at least partially used as a supporting column. The human skeleton is much more efficient for supporting load by the hips and legs than by the upper torso. The patented framework has many advantages and has proved its usefulness for many purposes, especially for those of a more recreational nature where attainment of maximum loads and optimal facility of maneuver are not of greatest concern. For example, a soldier who must run or crawl with it, or jump from an aircraft with it, will continue to wish for improvements. The instant invention provides them.

BRIEF DESCRIPTION OF THE INVENTION

This invention is an exoskeletal carriage intended to be worn on the human body. A belt at least partially encircles the waist, and a buckle is provided to tighten it so the belt can become a support for the entire structure, thereby by-passing the upper torso, leaving it largely free of columnar forces, and minimizing the side forces needed to stabilize the load in action.

A front blade-like member and a back blade-like member are attached to the front and back of the belt and rise above it. Their dimensions and physical properties are such that they are rigid or at most are stiffly flexible, so that there is little or no buckling or columnar bending under the anticipated loads.

Connector means joins the front and back blade-like members to resist their separation. Optionally, over-the-shoulder straps or arch members may be provided to assist in stabilizing the load and perhaps to assist in its support to a minor extent.

The loads may be applied directly to the blade-like members or if preferred, may be attached to a cloth cover which in turn is attached to the blade-like members. Optionally, the cloth cover can be in the nature of a vest that snugly fits over the blade-like members.

The mode of attachment of the blade-like members can take two principal forms. In both forms the vertical support of the members is accomplished, as it must be. However, there will be some situations where a more rigid connection to the belt will provide desired additional stiffness to the system. In that event, the attachments will themselves be made rigid, and may even constitute a large-area engagement. When more flexibility is desired, then the attachment may be a pin around which limited rotation of the member can occur. Optionally, the pin-type attachment can be provided with means that exerts a drag on the rotation to provide a more limited stiffness.

The above and other features of this invention will be fully understood from the following detailed description and the accompanying drawings, in which:

DETAILED DESCRIPTION OF THE INVENTION

Figure 1:
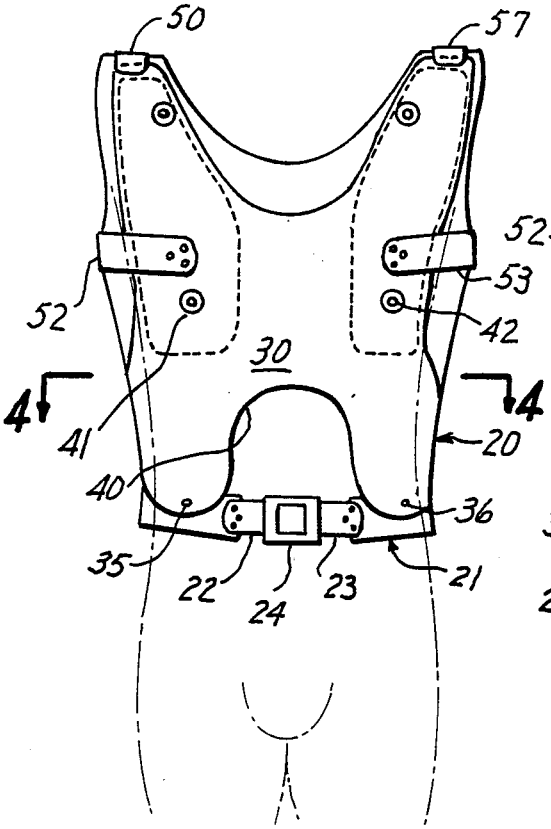
FIG. 1 is a front view of the presently-preferred embodiment of the invention.
Figure 2:
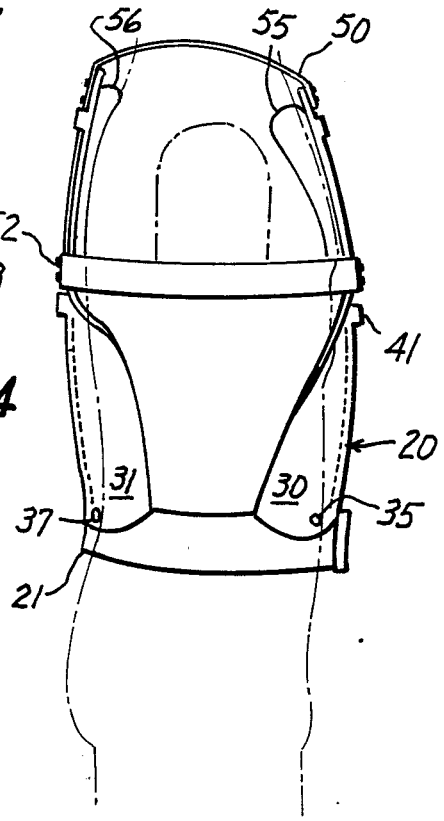
FIG. 2 is a right hand view of FIG. 1.
Figure 3:
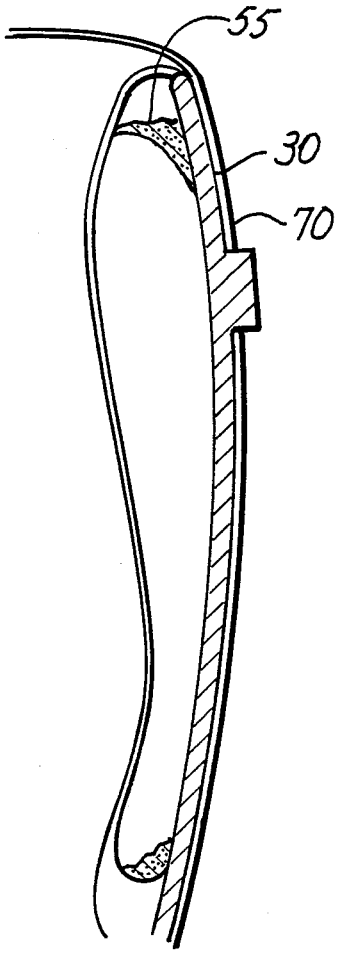
FIG. 3 is a fragmentary cross-section of a portion of FIG. 2.
Figure 4:
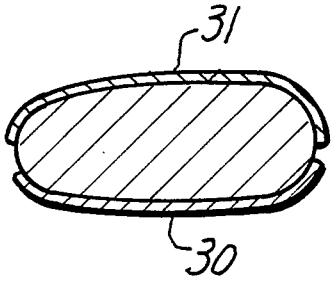
FIG. 4 is a cross-section taken at line 4—4 in FIG. 1.

The presently-preferred embodiment of a carriage 20 according to this invention is shown in FIG. 1. Its basic "anchor" to the body of the wearer is a belt 21 common to all of the embodiments. It is intended substantially to encircle the body of the wearer. It will embrace the back, the sides of the torso above the hips, and part of the abdomen. Straps 22, 23 and a buckle 24 complete the encirclement so the belt can be drawn tightly against the body, thereby to form an anchor for the structure.

Leather belts, webbing belts, elastic belts, and the like are useful with this invention, but for a person engaging in a vigorous activity they may represent an excessive restraint, especially as regards the expansions and contractions of breathing, and of vigorous side loads that result from abrupt drops to the ground.

To assist in the mounting of the belt, and its response to stringencies of use, the back, sides, and parts of the front can advantageously be provided with resilient pads (not shown). While these pads may merely be made of some soft and conformable material, they are most effective if they are made of open-cell rate-responsive foam, which responds conformably and gradually to gentle and gradual distortive forces(lower rate forces), but which responds with less readiness to more abrupt forces (higher rate forces). Thus, a conformable and reactive belt can be made which can be tightened to withstand downward forces, and still can yield favorably to peak forces.

Prior art devices which support the load from the shoulders do not respond to rigorous stringencies. For that matter, applicant's own patent U.S. No. 4,561,57 also does not, because it is directed to other problems. Notice for example that its frame is attached to the belt only at the sides. This invention takes the novel direction of columnar elements, front and back. Further, these can be made as protective elements which resist damaging deformation that could harm the wearer.

A front blade-like columnar member 30 and a rear blade-like columnar member 31 are mounted to the belt. They project above the belt, in front of the upper torso, and behind the upper back, respectively. These are both blade-like bodies, having suitable thicknesses, and substantial vertical and horizontal dimensions. Preferably each bends around toward the sides, around a vertical axis, so as to provide improved columnar properties. This is sometimes referred to as a "channel shape" because looking down, it will be seen as a channel The bends may either be permanent, such as by forming the members by a molding process, or they may be formed by the bending of an initially flat sheet held to a desired contour by attachment to the belt. In every event, the resulting structure is stiff enough to resist columnar collapse under the intended loads, and with the bends, the columnar effectiveness is considerably improved, especially compared to flat planar (unbent around the torso) members.

Attachment means 35, 36 serve to attach front blade-like member 30 to the belt. Attachment means 37 and a not-shown additional attachment means symmetrically placed serve to attach rear blade-like member 31 to the belt. While these attachments can be permanent, such as by large-area cement patches, it will be more convenient to provide the attachment as releasable fasteners. Stud and nut combinations are a suitable example. If some flexibility is desired for the system, these attachments may be pin-like, and thereby permit limited rotation around the pin. If desired, friction means could be included to yieldably limit the rotation. Should no rotation be desired, so as to provide a stiff joinder, then the fastener would be suitably tightened down. If desired, vertical slots (not shown) could be provided to enable limited up and down adjustability.

Figure 6:
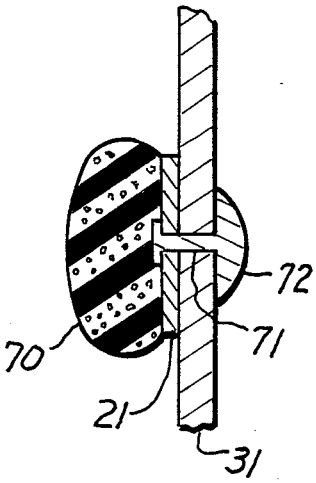
FIG. 6 is a fragmentary cross-section taken in FIG. 1 at the belt.

FIG. 6 shows a portion of belt 21 with a pad 70 as described, on its inside periphery. On the outside, a pin 71 projects from the belt and passes through one of the blade-like columnar members 31. Friction means 72 is attached to the pin and bears against member 31 yieldably to limit rotation around the pin. This fastener could be tightened down enough to prevent rotation if desired.

Members 30 and 31 may be lightened by providing cut-outs such as cut-out 40 in member 30. These will not materially weaken the columnar properties.

Mounting means such as studs 41, 42 may be attached to or formed as an integral part of the members. These provide means to attach a load such as a packbag to the columnar members.

Shoulder straps 50, 51 of flexible, perhaps elastic, material, may be used to interconnect the tops of the columnar elements. They may or may not transfer some of the load to the shoulders. They will serve to resist pendular swing of the structure.

Connector means 52, 53, of flexible, perhaps elastic, material extend below the arms to interconnect the sides of the front and back elements. These resist the tendency of the elements to "peel"apart at the top.

Straps 50, 51 and means 52, 53 are releasably attachable to the respective plate-like columnar members.

Buffer pads 55, 56 can be placed between the plate-like columnar numbers and the body to stabilize the structure against violent swings. These pads also may be made of rate-sensitive foam or of other cushioning material.

Figure 5:
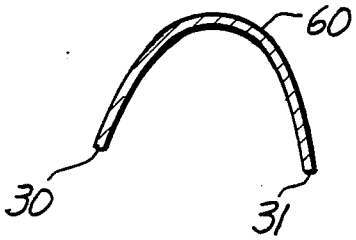
FIG. 5 is a fragmentary view of an arch-like connection between the blade-like members.

The embodiment of FIG. 5 differs from that of FIG. 1 by its inclusion of springy arch members that are integral with the front and back blade-like columnar members 30, 31 and extend over each shoulder. The members may be part of a uniform sheet bent to form the illustrated arch, or may be preformed to shape. Preferably they exert an outward swinging separation of the elements, at the belt, which is resisted by the belt. They do not necessarily contact the shoulders, and preferably will not. In the embodiment shown, the members can be shipped flat. All other features are identical to those of FIG. 1.

Instead of attaching the objects directly to the plate-like members, a cloth covering 70 can be applied over the members, and objects applied to it by fasteners such as Velcro brand hook and loop fasteners. This can spread the load and diminish the effects of localized blows. Also, instead of applying cloth to the elements, a garment such as a vest or coat can be put on over this assembly, and objects can be attached to it. An optimum material for covering 70 is a wick type material which would tend to move perspiration away from the body.

The members can be made of very light and strong material. Lightweight sheets of organic plastic resins reinforced by various types of cloth are good examples. They provide protection, load distribution, and columns to support the load from the waist, below the upper torso. The wearer has a new degree of freedom from binding by the structure, from fatigue, and from injury to his spine. The attainable loads are remarkably increased, all with a simple and relatively economical structure.

This invention is not to be limited by the embodiments shown in the drawings and described in the description, which are given by way of example and not of limitation, but only in accordance with the scope of the appended claims.

I claim:

1. An exoskeletal carriage to be worn on the human body to support and to carry objects attached thereto, said carriage comprising:

a belt at least partially to encircle the waist of a wearer, said belt being flexible and conformable to said waist, and adapted to be tight enough as not to slip downwardly appreciably under the vertical loads intended to be applied to it;

a front blade-like columnar member and a rear blade-like columnar member adapted to be placed to the front and to the rear of the wearer, above the waist;

attachment means attaching said columnar members to said belt so that they are supported by said belt;

each said columnar member comprising a blade like structure having a substantial area with a substantial vertical and horizontal dimension, and with a dimension of thickness and physical properties which render the member at least stiffly flexible, both of said columnar members; when on the body having a channel shape along at least a portion of their vertical dimension; and both of said columnar members covering substantial areas of the front and rear portions of the upper torso extending to each side of the torso of the wearer; whereby when attached to the belt and weighted downwardly by objects supported by it, the members behave as a columnar support with no more than minimal columnar bending; and connector means joining said front and back columnar members at a location above said belt to resist their separation, whereby articles may be mounted to said columnar members for carriage by the wearer and be principally supported by said belt.

2. An exoskeletal carriage according to claim 1 in which said belt is flexible and substantially inelastic, and in which deformable conformable pads are placed inside the belt to cushion and conform the belt to the wearer.

3. An exoskeletal carriage according to claim 2 in which at least some of said pads are made of a rate-sensitive open cell foam.

4. An exoskeletal carriage according to claim 2 in which said belt has a pair of ends, and in which buckle means is provided to join said ends and tighten the belt.

5. An exoskeletal carriage according to claim 1 in which a pair of flexible shoulder straps interconnect the columnar members near their upper edges.

6. An exoskeletal carriage according to claim 1 in which said attachment means are releasable from said belt.

7. An exoskeletal carriage according to claim 1 in which said front and back columnar members are joined by a pair of laterally spaced apart arch members, said members forming a continuous and integral structure.

8. An exoskeletal carriage according to claim 7 in which at least said arch members are inherently flat, and are bent to form said arch shape, thereby exerting a forwardly and rearwardly directed force on the belt at the attachment means with respect to a forwardly-facing person.

9. In combination: an exoskeletal carriage according to claim 7, and a cloth cover covering at least the outside surfaces of said columnar members to which articles are attached.

10. An exoskeletal carriage according to claim 1 in which said columnar members are inherently flat, and are bent around an upwardly-directed axis as the consequence of attachment to the belt, whereby to provide a more rigid columnar support.

11. An exoskeletal carriage according to claim 1 in which fastener means are joined to said columnar members as means for attachment of articles thereto.

12. In combination: an exoskeletal carriage according to claim 1, and a cloth cover covering at least the outside surfaces of said columnar members to which articles are attached.

13. A combination according to claim 12 in which said cloth covering constitutes part of a vest-like garment.

14. An exoskeletal carriage according to claim 1 in which said attachment means permit at least limited rotation around their point of attachment.

15. An exoskeletal carriage according to claim 14 in which said attachment means comprises a fastener which can be tightened to resist or to prevent said rotation.

16. An exoskeletal carriage according to claim 1 in which said attachment means is rigid and resists rotational movement around it except as a consequence of deformation.

17. An exoskeletal carriage according to claim 1 in which said members include integral studs for attachment of a load.

* * * * *